United States Patent [19]

Svensson et al.

[11] 4,274,786

[45] Jun. 23, 1981

[54] PROCESS AND APPARATUS FOR CONTINUOUSLY CONVEYING PARTICULATE COMPRESSIBLE FIBROUS MATERIAL FROM A ZONE AT A FIRST GAS PRESSURE TO A ZONE AT A SECOND GAS PRESSURE

[75] Inventors: Claes G. S. Svensson, Kode; Hans E. K. Eriksson, Örnsköldsvik; Rolf B. Lundgren, Sundsvall, all of Sweden

[73] Assignee: Mo och Domsjo Aktiebolag, Örnsköldsvik, Sweden

[21] Appl. No.: 10,106

[22] Filed: Feb. 7, 1979

[30] Foreign Application Priority Data

Feb. 10, 1978 [SE] Sweden ..... 7801586

[51] Int. Cl.[3] ..... D21C 7/06

[52] U.S. Cl. ..... 414/218; 162/18; 198/671; 241/247; 241/280

[58] Field of Search ..... 414/218, 190, 197, 786; 198/608, 661, 671; 162/18; 241/246, 247, 280

[56] References Cited

U.S. PATENT DOCUMENTS

| | | | |
|---|---|---|---|
| 2,681,737 | 6/1954 | Simenson et al. | 414/218 |
| 3,104,020 | 9/1963 | Klapp | 414/218 |
| 3,756,434 | 9/1973 | Teske | 414/218 |
| 3,841,465 | 10/1974 | Miller et al. | 198/608 X |

*Primary Examiner*—Robert G. Sheridan

[57] ABSTRACT

Process and apparatus are provided for continuously conveying particulate compressible fibrous material from a first zone at a first gas pressure to a second zone at a second gas pressure with a pressure differential therebetween of at least 0.5 bar while retaining the prevailing gas pressure in each zone, which comprises:

(1) continuously compressing the particulate material in the first zone into a gas-containing but gas-impermeable mass extending across the interface between the two zones;

(2) continuously passing the mass of material out from the first zone into the second zone while maintaining the gas pressure within the mass constant at the gas pressure of the first zone; and (3) continuously breaking up the mass entering the second zone into particulate material.

13 Claims, 3 Drawing Figures

PROCESS AND APPARATUS FOR CONTINUOUSLY CONVEYING PARTICULATE COMPRESSIBLE FIBROUS MATERIAL FROM A ZONE AT A FIRST GAS PRESSURE TO A ZONE AT A SECOND GAS PRESSURE

In many manufacturing processes, materials are treated with a gas at an elevated pressure, and normally also at an elevated temperature at which the rate of response to the treatment is increased. Such processes include absorption of one or more gases from mixtures thereof with other gases, pyrolysis, cellulose pulping and cellulose pulp-treating processes including, for example, bleaching, and impregnating processes preparatory to delignification and other extraction procedures.

In such processes, it usually becomes necessary to transfer the material being treated from the treating region at a high gas pressure to a region at a lower gas pressure, and this transfer must be carried out without loss of the gaseous medium used for the treatment or a reduction in pressure in the treating zone. Any gas which accompanies the material from the zone is lost, together with its heat and chemical contents, while the gas pressure is also reduced. If gas accompanies the material exiting from the zone, and the gas can escape from the material in the course of the departure from the zone, the gas pressure within the material will decrease, and the material will at the same time increase in density and decrease in elasticity. These changes are accompanied by an increase in friction between the material and the surfaces with which it comes into contact during the departure. Friction may also increase the temperature of the material with deleterious effects on the stability of the material. In addition, the material may reach its softening point, and begin to adhere to the walls of the zone, resulting in an impairment of the quality of the material, and possibly even an interruption in the treatment process. Such problems frequently arise in the drying of fibrous cellulosic material, peat, or wood bark in the manufacture of paper pulp and solid fuels.

Various types of apparatus have been proposed to overcome these difficulties. One device transfers the material from one zone to another by way of an elongated screw conveyor, which extends across the interface between the two zones and discharges a compacted mass of material into the second zone. A restraining device arranged across the discharge opening obstructs the flow of material from the conveyor into the second zone. As a consequence of this obstruction, the material backs up in the screw conveyor and under internal pressure is consolidated to form a gas-impervious mass of material which seals the screw casing against loss of gas therethrough into the second zone, while at the same time the mass of material is continuously discharged by the screw as it is formed into the region of lower pressure.

Such an apparatus is described, for example, in U.S. Pat. No. 3,756,434 to Lothar Teske, patented Sept. 4, 1973. The apparatus of this patent includes a screw conveyor for conveying bulk particulate material from one zone to another at different gas pressures. The screw of the conveyor rotates in an elongated chamber along which a mass of the material is transported towards the outlet from the conveyor, and is compressed and seals against the housing while it does so. A restraining device obstructs the flow of material out the outlet end. The restraining device is spring-biased towards the outlet opening, so that the material is held in the chamber under the pressure imposed by the spring, and is thus discharged under that pressure.

This device discharges a more or less continuous mass of the consolidated particulate material, which then has to be broken up by other means, in order to reduce it to particulate form for further treatment.

U.S. Pat. No. 3,841,465 to Clarence S. Miller, Jr., and George A. Seely, patented Oct. 15, 1974, describes an improvement on this system which includes a device for breaking up the plug of material as it is discharged into the second zone. This apparatus is especially designed for conveying domestic or industrial waste into a furnace. The apparatus utilizes two screw conveyors in series, one after the other, with the furnace at the discharge end of the last conveyor, and with an intermediate expansion chamber between the two conveyors. A restraining device is placed across the outlet opening from the first screw conveyor. This device is of a conical configuration, with the apex of the cone facing the outlet, and the device is rotatable in such a manner as to disintegrate the mass of material as it is discharged through the outlet.

In the system shown in this patent, the material is being conveyed from a region of low pressure into a region of higher pressure. In this case, the consolidated mass of material that is formed is relatively compact, and is practically free of entrained gas. As a result, it forms an effective seal in the discharge passage from the conveyor housing between the two zones of different gas pressure. A conical restraining device does not impose enough pressure on the mass of material in the discharge passage, however, to give a good seal between the mass and the housing wall that will retain gas pressure in the first zone, when the first zone is at a higher pressure than the second zone, unless the pressure differences are small. When there is a relatively high differential pressure, in excess of about 0.5 bar, because an effective seal is not obtained between the mass and the housing wall, there is leakage of gas from the region of higher pressure as the plug is conveyed from the first into the second zone.

This is because the conical restraining device does not seal against the end of the mass of material as it is being discharged from the outlet opening. Instead, the conical device breaks the end portions of the mass into pieces of differing size, resulting in leakage of gas from the first zone through the mass.

In accordance with the present invention, apparatus and a process are provided for continuously conveying particulate compressible fibrous material from a first zone at a first gas pressure to a second zone at a second gas pressure with a pressure differential therebetween of at least 0.5 bar while retaining the prevailing gas pressure in each zone, which comprises:

(1) continuously compressing the particulate material in the first zone into a gas-containing but gas-impermeable mass extending across the interface between the two zones;

(2) continuously passing the mass of material out from the first zone into the second zone while maintaining the gas pressure within the mass constant at the gas pressure of the first zone; and (3) continuously breaking up the mass entering the second zone into particulate material.

In the apparatus of the invention a restraining device is arranged across the discharge opening from the screw conveyor so as to be rotatable to break up the mass of material as it is discharged from the outlet opening of the conveyor housing and so as to seal against the end of the housing and against the end of the mass of material being discharged while applying sufficient resistance to the discharge of material from the housing as to consolidate the material being conveyed therethrough into a gas-containing but gas-impermeable mass that seals against the housing walls and maintains the gas pressure in the mass constant at the gas pressure of the first zone.

The apparatus in accordance with the invention accordingly includes a screw conveyor for conveying particulate material between two zones at different prevailing gas pressures, comprising a conveyor housing adapted to extend across an interface between the two zones; a conveyor passage through the housing having an inlet in the first zone and an outlet in the second zone; a helical screw arranged for rotation in the passage for conveying material along the passage from the inlet towards the outlet; a rotatable restraining device movable between positions across and closing off the outlet and spaced from the outlet sufficiently to allow material conveyed by the screw to be discharged through the outlet; and having a substantially planar surface facing and contacting and arranged to seal against the mass of material at the discharge opening and apply pressure to the mass sufficient to cause the mass to seal against both the walls of the conveyor passage and the planar surface of the restraining device while it is being discharged from the outlet; disintegrating means operatively connected with the restraining device for rotation therewith for breaking up the mass of material; whereby gas entrained in the mass is maintained there within substantially without loss and at substantially the same pressure as the gas pressure in the first zone until it is released in break-up of the mass of material by the disintegrating means.

Experiments have shown that the quantity of gas entrained in the mass of material and released when the material is broken up by the disintegrating means is very small, and of no practical significance, regardless of the pressure difference between the first and second zones.

Preferred embodiments of the process and apparatus of the invention are illustrated in the drawings, in which.

Figure 1:
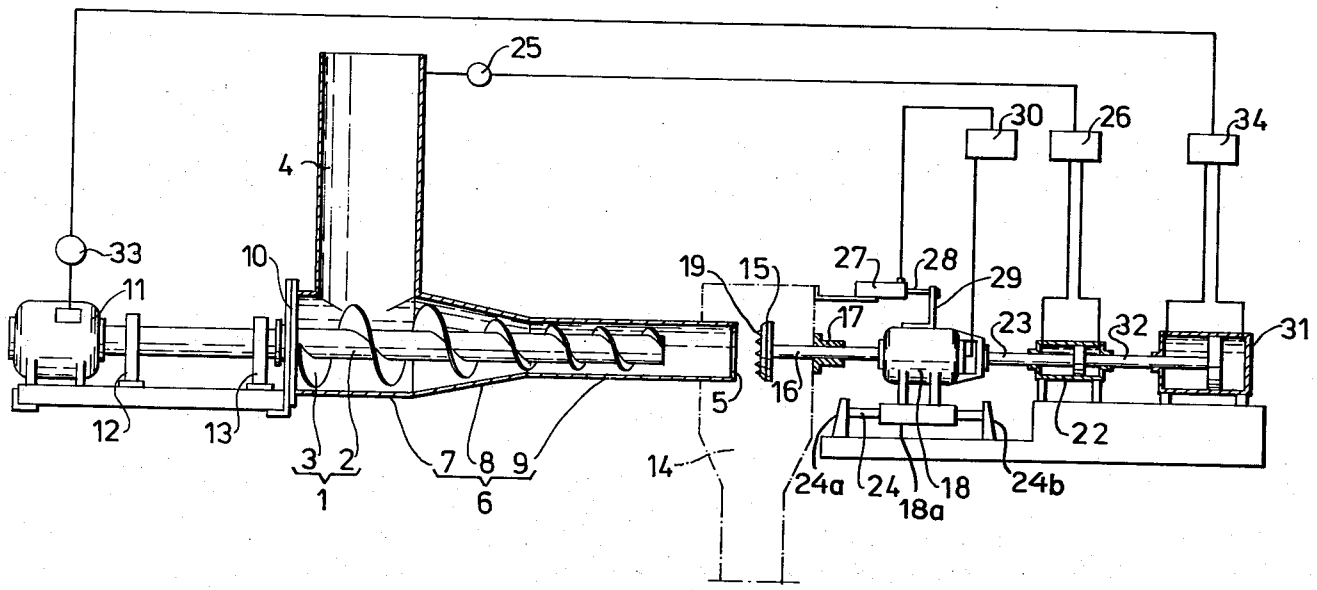
FIG. 1 is a side view of an apparatus in accordance with the invention, with the screw conveyor shown in cross-section, and with the restraining device for purposes of illustration being spaced at a greater than normal distance from the outlet opening of the conveyor.
Figure 2:
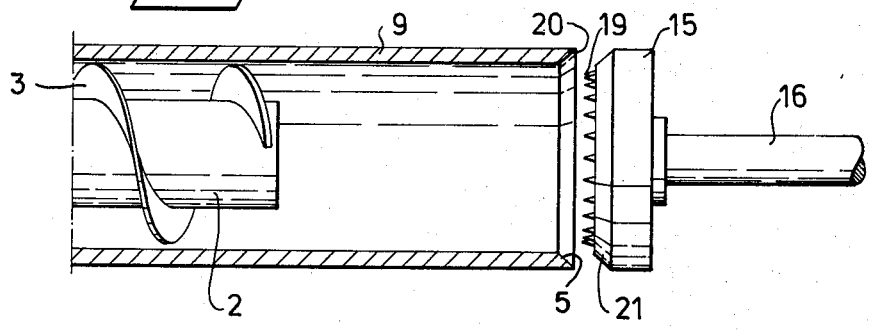
FIG. 2 shows in detail the restraining device and the adjacent parts of the conveyor in the apparatus of FIG. 1.

The apparatus shown in FIGS. 1 and 2 has a conveyor screw 1 comprising a screw shaft 2 which carries a worm or screw helix 3. The screw shaft and screw helix are arranged for rotation within a screw passage 6 having an inlet opening 4 and an outlet opening 5. The passage 6 is of smaller diameter in the portion 9 adjacent the outlet opening 5 and of larger diameter in the portion 7 adjacent to the inlet opening 4, with a tapered or conical portion 8 joining the two sections. Accordingly, material being conveyed by the screw 3 through the passage sections 7, 8, 9 is compressed as it enters the narrower section 9, and further consolidated there.

The inlet 4 accepts particulate material to be conveyed from a first zone at a prevailing gas pressure. The inlet end of the passage 7 is closed off by the end plate 10, through the aperture **10*a* of which the screw shaft 2 extends, for coupling with the electric motor 11 for rotating the shaft. Supporting the shaft for such rotation are two bearing blocks 12, 13, in which the shaft 2 is journaled as shown. The screw shaft does not extend all the way to the outlet opening 5, but only approximately half-way along the narrower portion 9 of the passage. As seen in FIG. 1, the screw 3 extends through the passage sections 7, 8, 9** without touching the walls thereof, spaced at a distance of from 2 to 5 mm from these walls.

The discharge end 9 of the conveyor passage 6 extends into a housing 14 defining a second zone of differing and generally reduced gas pressure, which is connected to another device (not shown) for further tretment of the material discharged into the housing 14 from the screw conveyor.

A disc-shaped restraining device 15 is provided adjacent and facing the outlet opening 5 of the conveyor housing. This disc has a chamfered or tapered periphery adapted to seal against a correspondingly chamfered or tapered wall about the outlet 5, closing it off. The surface of the plate 15 facing the outlet opening 5 is provided with disintegrating means, in this case, in the form of a plurality of pointed shredders 19.

The plate 15 is carried at one end of the rotatable shaft 16, which is journaled for rotation in a shaft bearing 17 mounted on the housing 14, and is coupled at the other end to an electric motor 18, which is arranged to rotate the shaft 16 and the plate 15 and with it the shredder means 19, preferably in a direction opposite to that of the conveyor screw 3 for an enhanced disintegrating effect, but optionally in the same direction but at a different rate.

The shaft 16 and with it the plate 15 together with the motor 11 to which it is operatively connected are arranged to be moved reciprocably so that the plate 15 moves into and away from sealing engagement with the housing wall adjacent the outlet opening 5. This is done by supporting the motor 18 on a bearing **18*a* which can move along the guide 24, itself carried on the two supports 24*a*, 24*b***.

Fixedly connected to the drive motor 18 is a piston 23, which moves within the piston cylinder 22. The piston 23 is in turn attached to the piston rod 32, reciprocably movable within the piston cylinder 31. The control device 34 is of the on-off type, and controls the movement of the piston 32 within the cylinder 31, which in turn moves the piston 23 within the cylinder 22, and this in turn moves the motor 18 along the guide 24, carrying with it the shaft 16 and the plate 15.

The axial movement of the plate 15 is coordinated with the pressure in the screw conveyor and regulated by way of the electric pressure transducer 25 connected to the inlet line 4 of the conveyor and a pressure converter 26 is connected between the pressure transducer 25 and the hydraulic cylinder 22. The pressure transducer has a pressure-responsive membrane fixed to an iron core that is reciprocable within an electric coil, so that pressure changes are reflected in the position of the core within the coil, giving an electric response dependent on that position. Control of these axial movements is automatically carried out in such a way that the plate 15 is urged with increased force towards the outlet opening 5 when the pressure in the inlet line 4 increases, and with a lesser force when the pressure in the inlet line decreases. The pressure-transducer 25 and the pressure converter 26 are of conventional known design and form no part of the instant invention.

The distance or spacing of the plate 15 from the outlet opening 5 is continuously displayed by an electrically operated position transmitter 27, mounted on the housing 14. This position transmitter is of conventional design, and includes an electric coil and an iron core 28 that is reciprocable within the coil. A bar 29 is fixedly mounted between the core and the motor 18. Axial movement of the iron core in the coil is transmitted to a position and revolution converter 30 in the form of electric signals which reflect the direction in which the core moves in the coil, and the extent of the movement. The converter 30 is also of known conventional design, and controls the number of revolutions made by the motor 18 in response to the signals obtained from the position transmitter 27. This control is effected automatically, in such a manner that the rate of rotation of the motor, and therewith also of the plate 15, decreases when the plate is moved towards the outlet opening 5, and increases when the plate is moved away from the outlet opening 5.

Activation and deactivation of the hydraulic cylinder 31 is controlled by means of the power meter 33 connected to the motor 11 and the device 34 connected between the meter 33 and the piston cylinder 31. This control is effected automatically by the power meter 33, which sends out a first control signal whenever the power output of the motor 11 falls beneath a given minimum. This signal is transmitted to the limit device 34, which actuates the hydraulic cylinder 31 in response thereto. The piston of the hydraulic cylinder 31 then together with the hydraulic piston and cylinder 22 urges the plate 15 into sealing abutment with the outlet opening 5 of the conveyor. When the power output of the motor 11 increases to a value above a predetermined maximum, the power meter 33 sends a second control signal to the limit device 34, which deactuates the hydraulic piston/cylinder device 31 in response thereto.

The operation of the apparatus of FIGS. 1 and 2 is as follows: First, the disc 15 is moved into position across the outlet end 5 of the conveyor, closing it, by means of the two hydraulic piston/cylinder devices 22, 31. Particulate material such as, for example, defibrated cellulose pulp having a solids content between 30 and 90% and a density within the range from about 10 to about 150 kg/m$^3$ is then charged into the conveyor by way of the inlet 4. The material is charged continuously through the inlet opening, and conveniently at a rate within the range from about 0.5 to about 8 kg of pulp-/second, preferably between 1.5 and 2 kg of pulp-/second, from, for example, a zone in which the pulp has been dried using steam or other suitable gas at a pressure of about 5 bar and a temperature of about 150° C. Only a relatively small part of the total capacity of the screw conveyor is used. The pulp is advanced towards the outlet opening 5 by the rotation of the conveyor screw 3, while surrounded by steam. The extent to which the conveyor passage 7, 8, 9 is filled does not normally exceed 35% of its capacity during the process, but it may be between 5 and 80% while still being functional and fully operative.

During the initial stage of the operation, while the screw is being filled with material which is compressed within the passage 9, the outlet opening 5 is kept closed by the plate 15 at a pressure which exceeds the pressure of the steam within the passage by approximately 3 bar. As pulp continues to be charged through the inlet opening 4 into the inlet end of the passage 7 of the conveyor, the mass of material within the passage 9 and after the helix 3 is formed increasingly into a mass of progressively increasing density, in which steam is entrained in cavities located between the particles, and within the particles of the pulp forming the mass. The mass continues to be built up by the continuing application of layers of steam-containing pulp, as the helical screw 3 rotates and carries more material into the narrow passage 9. The steam present in the mass imparts a certain resiliency to the mass, and a low density, which facilitates the disintegration or breaking up of the mass by the shredder 19 in the next stage.

As the consolidation of the mass of material increases, the mass moves forward into sealing abutment with the wall of the passage and with the restraining plate 15, sealing off the outlet opening 5. As it does so, the load on the screw conveyor increases, and the power output of the motor 11 which is continuously sensed by the power meter 33 also increases correspondingly. When the power output has reached a given predetermined limiting value, the power meter sends a further control signal to the limit device 34, which immediately deactuates the hydraulic piston/cylinder 31 in response thereto, and causes the piston thereof to move to the right. This means that the pressure on the side of the restraining plate 15 facing the outlet opening 5 exceeds the pressure at which the plate is pressed against the outlet opening 5 by the piston 23 of the hydraulic cylinder 22. As a result, the plate is urged slightly to the right by the mass of material, exposing an annular opening several millimeters wide between the outlet opening 5 and the plate 15 about its external periphery.

Now the motor 18 is energized, causing the restraining plate 15 to rotate. As a result, the end of the plug abutting the plate is shredded by the shredding device 19 over a uniform surface into relatively small pieces. The shredded material is thrown radially outwardly from the plate into the housing 14, for further transport to an apparatus (not shown) in which the disintegrated pulp particles are pressed into bale form. Because of the sealing abutment of the mass of material in the passage 9 against the plate 15, and the narrow opening between the plate and the oulet opening of the conveyor, as well as the gas-imperviousness of the consolidated mass of material, only the steam entrained in the portion of the mass that is shredded is released during the shredding operation. In consequence, the steam entrained in the remainder of the mass is retained therein at unchanged pressure, and at a volume ratio between steam and pulp which is dependent on the steam pressure, the properties of the pulp and the amount of pulp charged to the conveyor, but which, in the Example shown, is approximately 3:1. Thus, under normal conditions, the mass of material retains its high resiliency and its low density practically constant throughout the transfer from the inlet 4 to the housing 14, as a result of the effect of the plate 15. Consequently, the risk of the material's being heated by increased friction, resulting in adherence of the material to the conveyor housing walls, or to an extent such that the fiber structure of the pulp is impaired, is entirely avoided.

To compensate for those changes in steam pressure and in the rate of feed of pulp to the conveyor which may occur, and to compensate for any changes in the properties of the material being charged, the apparatus is provided with means for automatically controlling the distance or spacing between the outlet opening 5 and the plate 15, and for controlling the force with which the plate 15 is urged against the mass of material in the outlet opening by the hydraulic piston/cylinder 22. This distance or spacing is controlled by the position transmitter 27 and the revolution converter 30, in accordance with the amount of pulp charged to the conveyor at the inlet opening 4 per unit time.

Accordingly, the position transmitter 27 is arranged to continuously sense this distance or spacing, and to send to the revolution converter 30 signals corresponding to the sensed values. The converter controls the number of revolutions of the motor 18 in response to the content of these signals. This control is effected in such a manner that the speed of the motor increases when the distance between the plate 15 and the outlet opening 5 increases and decreases when this distance decreases. The result is that when an increased quantity of pulp is charged to a conveyor, the mass of material is urged a slightly greater distance out through the outlet opening and presses the restraining plate towards the right. When as a result the speed at which the plate rotates is increased through the revolution converter 30, the plate tears material from the end of the mass at a correspondingly increased rate, which means that the displacement of the plate is slowed down.

If, on the other hand, the supply of pulp to the conveyor decreases, the sequence is reversed. The plate is moved somewhat closer to the outlet opening, the revolution counter 30 then immediately causes the rate of rotation of the plate to decrease, with the result that the shredding rate decreases and the displacement of the plate is halted. Thus, the restraining plate assumes a new position determined by the change in supply of pulp to the conveyor at the speed of rotation corresponding to that position.

This cooperation between the speed of rotation of the plate and its axial displacement ensures that the axial position of the plate is maintained within relatively narrow limits, regardless of any normal variations in the amount of pulp charged to the conveyor per unit of time. Because the distance between the plate 15 and the outlet opening 5 of the conveyor varies only to an insignificant extent under normal operating conditions the restraining plate can be adjusted in a manner such that the spacing between the plate and the outlet opening can be the smallest possible opening that permits the shredded material to pass out. There is consequently a reduction in the amount of gas which unavoidably leaks through the gap despite the sealing effect of the mass of material, while at the same time the conveyor housing acts as a support which tends to hold the mass of material together along the whole of the conveyor passage up to the vicinity of the outlet 5, where the mass is shredded by the device 19. In the device shown, the width of the gap is about 3 mm. However, it may vary from 1 to 50 mm, with the aid of the position indicator 27 and the revolution converter 30.

As indicated, the distance at which the plate 15 is spaced from the outlet opening 5 of the conveyor is affected by variations in the amount of pulp charged to the conveyor per unit time. The pressure at which the plate is pressed against the mass of material being discharged is also significant, however. The density of the mass is dependent upon the amount by which the pressure exerted by the plate exceeds the gas pressure in the conveyor. Normally, this difference is about 0.5 bar, with a 4 bar gas pressure and a 4.5 bar counterpressure on the restraining plate 15, being the values assumed in the illustrated embodiments.

The gas pressure may vary for different reasons in the drying plant connected to the conveyor, however, in which case the gas pressure will also vary in the conveyor. When the gas pressure in the conveyor varies, the density in the mass will also tend to change. If, for example, the gas pressure decreases while the counterpressure of the plate 15 remains the same, there is an increase in the pressure difference between the two, as a result of which the density of the mass will increase. An increase in the gas pressure gives the opposite result. These variations in pressure difference are eliminated, however, by means of the pressure transducer 25 and the pressure converter 26, which make it possible to regulate the counterpressure applied by the plate 15.

This regulation of the counterpressure is effected automatically, because the pressure transducer 25 is arranged to sense continuously the steam pressure in the inlet line 4 to the screw conveyor, and to send to the pressure converter control signals which correspond to the values sensed. The pressure converter controls the force exerted on the plate by the hydraulic cylinder 22 in response to the nature of these signals, in such a manner that the plate 15 is pressed against the mass of material with an increasing force when the pressure increases in the inlet line 4. When the pressure in the inlet line decreases, the reverse takes place, that is, the counterpressure of the plate 15 is decreased by way of the pressure converter. In both instances, the counterpressure exerted by the restraining plate is stabilized when the predetermined pressure difference is reestablished, as a result of which the density of the mass is maintained substantially constant, despite the change in gas pressure.

A number of variations can be made in the device shown in FIGS. 1 and 2. Thus, the helix of the converyor screw can be given a pitch which decreases towards the outlet, or which decreases only on the last turn before the outlet. In this way, the mass becomes more porous, which in turn means that it is subjected to less friction during passage through the passages 7, 8, 9, resulting in less heat being developed, and less energy being consumed.

The pitch of the helix along the axis of the screw also determines the volume ratio between gas and solid material. Thus, the helix can be provided with a smaller pitch at its final turns nearest the outlet opening 5.

As a result of the sealing function of the restraining plate 15, the volume ratio between gas and solid material may reach about 7:1 in operational conditions which are normal in other respects without risking an appreciable increase in gas leakage through the mass of material in the passage 7, 8, 9. The lowest limit of the volume ratio between gas and material in the mass can be set at about 0.5:1, which limit is mainly determined by the frictional heat developed in the mass during passage through the passage 7, 8, 9.

Conveniently, one or both of the abutting surfaces of the restraining plate and the outlet opening of the conveyor, which are in sealing relationship at the beginning of the operation, can be provided with a circumferentially extending sealing strip of resilient material, such as, for example, rubber or some other gasketing material.

The shredding means 19 of the plate 15 can be modified and given any suitable known form.

In the device shown in FIGS. 1 and 2, the screw conveyor passage 6 has a wider inlet section 7 and a narrower outlet section 9, with a conical section 8 connecting the two sections. However, other designs of conveyor can be used. The conical part 8 of the passage may be arranged at any part of the passage, and the helix of the screw can be modified in accordance with the configuration of the passage. It is also possible to arrange the conical portion 8 of the passage so that it tapers in the opposite direction from the conveying direction.

The conveyor passage may also be entirely conical or entirely cylindrical in shape.

The conveyor passage, the helix and/or the screw shaft can also be provided with discharge openings, for removing water and other liquid material present in the mass of material. These openings can carry the liquid into a vessel outside the conveyor housing, in which the gas pressure is maintained at substantially the same gas pressure as in the conveyor.

Figure 3:
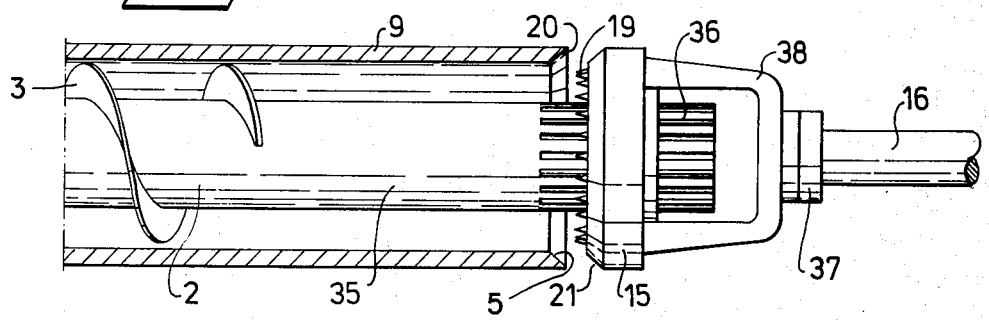
FIG. 3 shows in longitudinal section another embodiment of conveyor and restraining device in accordance with the invention.

In another embodiment, the restraining plate 15 can be axially displaceable on a part of the screw shaft of the conveyor. Such an embodiment is illustrated in FIG. 3, in which parts similar to those in FIGS. 1 and 2 are given like reference numerals.

In this embodiment, the screw shaft 2 has an extended portion 35, which extends through the discharge opening, and is provided at its outer portion with splines 36, on which the restraining plate 15 is arranged for axial movement, and by which it is caused to rotate together with the shaft 35. As in the apparatus of FIGS. 1 and 2, the restraining plate 15 is displaced axially along the splines 36 by means of the hydraulic piston/cylinders 22,31, which are connected to a stirrup structure 38 mounted on the restraining place 15 via the shaft 16 in a spherical axial roller bearing 37. In this embodiment of the apparatus, the motor 18 is no longer required, and is therefore omitted, together with the position transmitter 27 and the revolution counter 30. Accordingly, the arrangement of FIGS. 1 and 2 may be preferred if these variations are desired to introduce flexibility into the operation.

In order to reduce the tendency of the pulp to be entrained in a circulatory path around the screw shaft during transfer of the pulp towards the outlet opening 5, the passage 6 of the screw conveyor is conveniently provided with internally fixed baffles. These can be arranged on one or more of the passage walls 7, 8, 9 of the housing, and also in that part of the passage located beyond the last turn of the helix 3 before the outlet opening. This provision of baffles requires a somewhat larger clearance between the outer periphery of the helix 3 and the walls of the passage 7, 8, 9.

Having regard to the foregoing disclosure, the following is claimed as the inventive and patentable embodiments thereof:

1. A process for continuously conveying particulate compressible fibrous cellulose pulp material having a solids content between 30 and 90% and a density within the range from about 10 to about 150 kg/m$^3$ from a first zone at a first gas pressure to a second zone at a second gas pressure with a pressure differential therebetween of at least 0.5 bar while retaining the prevailing gas pressure in each zone, which comprises:

(1) continuously compressing the particulate material in the first zone into a gas-containing but gas-impermeable resilient mass of low density extending across the interface between the two zones;

(2) continuously passing the mass of material out from the first zone into the second zone at a flow rate within the range from about 0.5 to about 8 kg of pulp per second while maintaining the gas pressure in the mass constant at the gas pressure of the first zone; and (3) continuously breaking up the mass entering the second zone into particulate material;

substantially without impairing the quality of the pulp fibers.

2. A process according to claim 1 which comprises maintaining the volumetric ratio of gas:material in the mass within the range from 0.5:1 and 7:1.

3. A process according to claim 1 in which the fibrous material is dry cellulose pulp.

4. A process according to claim 1 which comprises breaking up the mass into flakes.

5. An apparatus for continuously conveying particulate compressible fibrous cellulose pulp material having a solids content between 0 and 90% and a density within the range from about 10 to about 150 kg/m$^3$ from a first zone at a first gas pressure to a second zone at a second gas pressure with a pressure differential therebetween of at least 0.5 bar while retaining the prevailing gas pressure in each zone, and substantially without impairing the quality of the pulp fibers, which comprises:

(1) screw conveyor means for continuously compressing the particulate material in the first zone into a gas-containing but gas-impermeable resilient mass of low density extending across the interface between the two zones; and for continuously passing the mass of cellulose pulp material out from the first zone into the second zone while maintaining the gas pressure in the mass constant at the gas pressure of the first zone constant; the screw conveyor comprising a conveyor housing extending across an interface between the two zones; a conveyor passage through the housing having an inlet in the first zone and an outlet in the second zone; the passage having a portion of larger diameter adjacent the inlet and a portion of lower diameter adjacent the outlet, and a tapered portion connecting the inlet and outlet portions; a helical screw arranged for rotation in the passage and having an outer periphery extending through the passage portions spaced at a distance of from 2 to 5 mm from the housing wall with a correspondingly larger diameter in the inlet portion than the outlet portion for conveying cellulose pulp material along the passage from the inlet towards the outlet;

(2) means for continuously breaking up the mass entering the second zone into particulate material; comprising a rotatable restraining device movable between positions across and closing off the outlet and spaced from the outlet sufficiently to allow material conveyed by the screw to be discharged through the outlet; and having a substantially planar surface facing and contacting and arranged to seal against the mass of cellulose pulp material at the discharge opening and apply pressure to the mass sufficient to cause the mass to seal against both the walls of the conveyor passage and the planar surface of the restraining device while it is being discharged from the outlet; and (3) disintegrating means operatively connected with the restraining device for rotation therewith for breaking up the mass of cellulose pulp material; whereby gas entrained in the mass is maintained therewithin substantially without loss and at substantially the same pressure as the gas pressure in the first zone until it is released in break-up of the mass of cellulose pulp material by the disintegrating means.

6. An apparatus according to claim 5 in which the means (3) comprises a planar disc that is rotatable to break up the mass of material as it is discharged from the outlet opening of the conveyor housing and so as to seal against the end of the mass of material while it is being discharged into the second zone while applying sufficient resistance to the discharge of material as to consolidate the material being conveyed therethrough into a gas-containing but gas-impermeable mass that maintains the gas pressure in the mass constant at the gas pressure of the first zone.

7. An apparatus according to claim 5 in which the disintegrating means is a shredding means.

8. An apparatus for continuously conveying particulate compressible fibrous material from a first zone at a first gas pressure to a second zone at a second gas pressure with a pressure differential therebetween of at least 0.5 bar while retaining the prevailing gas pressure in each zone, which comprises:

(1) screw conveyor means for continuously compressing the particulate material in the first zone into a gas-containing but gas-impermeable mass extending across the interface between the two zones; and for continuously passing the mass of material out from the first zone into the second zone while maintaining the gas pressure in the mass constant at the gas pressure of the first zone; the screw conveyor comprising a conveyor housing adapted to extend across an interface between the two zones; a conveyor passage through the housing having an inlet in the first zone and an outlet in the second zone; a helical screw arranged for rotation in the passage for conveying material along the passage from the inlet towards the outlet; and (2) means for continuously breaking up the mass entering the second zone into particulate material; comprising a rotatable restraining device movable between positions across and closing off the outlet and spaced from the outlet sufficiently to allow material conveyed by the screw to be discharged through the outlet; and having a substantially planar surface facing and contacting and arranged to seal against the mass of material at the discharge opening and apply pressure to the mass sufficient to cause the mass to seal against both the walls of the conveyor passage and the planar surface of the restraining device while it is being discharged from the outlet; and disintegrating means operatively connected with the restraining device for rotation therewith for breaking up the mass of material; whereby gas entrained in the mass is maintained therewithin substantially without loss and at substantially the same pressure as the gas pressure in the first zone until it is released in break-up of the mass of material by the disintegrating means; and having a position transmitter, a revolution converter and a drive motor operatively connected to the restraining device, the position transmitter being connected to the revolution converter, and arranged to control the same in response to axial movements made by the restraining device, in a manner such that the number of revolutions decreases when the restraining device is moved towards the outlet and increases when the restraining device moves away from the outlet.

9. An apparatus for continuously conveying particulate compressible fibrous material from a first zone at a first gas pressure to a second zone at a second gas pressure with a pressure differential therebetween of at least 0.5 bar while retaining the prevailing gas pressure in each zone, which comprises:

(1) screw conveyor means for continuously compressing the particulate material in the first zone into a gas-containing but gas-impermeable mass extending across the interface between the two zones; and for continuously passing the mass of material out from the first zone into the second zone while maintaining the gas pressure in the mass constant at the gas pressure of the first zone; the screw conveyor comprising a conveyor housing adapted to extend across an interface between the two zones; a conveyor passage through the housing having an inlet in the first zone and an outlet in the second zone; a helical screw arranged for rotation in the passage for conveying material along the passage from the inlet towards the outlet; the screw conveyor passage being provided with splines on which the restraining device is axially displaceable and by which said device is caused to rotate together with the screw; and (2) means for continuously breaking up the mass entering the second zone into particulate material; comprising a rotatable restraining device movable between positions across and closing off the outlet and spaced from the outlet sufficiently to allow material conveyed by the screw to be discharged through the outlet; and having a substantially planar surface facing and contacting and arranged to seal against the mass of material at the discharge opening and apply pressure to the mass sufficient to cause the mass to seal against both the walls of the conveyor passage and the planar surface of the restraining device while it is being discharged from the outlet; and disintegrating means operatively connected with the restraining device for rotation therewith for breaking up the mass of material; whereby gas entrained in the mass is maintained therewithin substantially without loss and at substantially the same pressure as the gas pressure in the first zone until it is released in break-up of the mass of material by the disintegrating means.

10. An apparatus according to claim 5 having a pressure cylinder and piston operatively connected to the restraining device to move it towards and away from the outlet.

11. An apparatus according to claim 10 having a pressure transducer arranged to sense continuously the gas pressure at the inlet of the screw conveyor; and a pressure converter connected to the pressure cylinder and piston for controlling the same in response to the values sensed by the pressure transducer in a manner such that the restraining device is urged by the pressure cylinder and piston with an increased force towards the outlet when the pressure of the gas in the inlet increases, and with a reduced force when the pressure of the gas at the inlet decreases.

12. An apparatus according to claim 10, having a second pressure cylinder and piston arranged to urge the restraining device into sealing abutment with the outlet.

13. An apparatus according to claim 12, having a limiting device and a power meter cooperating therewith, the power meter being arranged to measure the power output in rotating the helical screw, and to actuate the limiting device when the power output falls beneath a predetermined limit, the said limiting device when activated being arranged to activate the second pressure cylinder and piston.

* * * * *

UNITED STATES PATENT AND TRADEMARK OFFICE

CERTIFICATE OF CORRECTION

PATENT NO. : 4,274,786

DATED : June 23, 1981

INVENTOR(S) : Claes Goran Sigurd Svensson et al

It is certified that error appears in the above-identified patent and that said Letters Patent are hereby corrected as shown below:

Column 3, line 34 : "there within" should be --therewithin--

Column 4, lines 18 and 19 : "tret-ment" should be --treatment--

Signed and Sealed this

Tenth Day of December 1985

[SEAL]

Attest:

DONALD J. QUIGG

Attesting Officer

Commissioner of Patents and Trademarks